United States Patent [19]

Teppa

[11] Patent Number: 4,589,218

[45] Date of Patent: May 20, 1986

[54] MULTI-STACK CARTRIDGE MAGAZINE FOR FIREARMS

[75] Inventor: Roberto Teppa, Turin, Italy

[73] Assignee: Sites S.p.A., Mondovi, Italy

[21] Appl. No.: 624,844

[22] Filed: Jun. 26, 1984

[51] Int. Cl.[4] ..... F41C 25/02

[52] U.S. Cl. ..... 42/50

[58] Field of Search ..... 42/50

[56] References Cited

U.S. PATENT DOCUMENTS

| | | | |
|---|---|---|---|
| 2,217,848 | 10/1940 | Schillstrom | 42/50 |
| 3,226,869 | 1/1966 | Musgrave | 42/50 |
| 3,672,089 | 6/1972 | Silsby | 42/50 |

FOREIGN PATENT DOCUMENTS

| | | | |
|---|---|---|---|
| 569280 | 2/1933 | Fed. Rep. of Germany | 42/50 |
| 654386 | 12/1937 | Fed. Rep. of Germany | 42/50 |

*Primary Examiner*—Charles T. Jordan

*Attorney, Agent, or Firm*—Sughrue, Mion, Zinn, Macpeak & Seas

[57] ABSTRACT

A firearm magazine comprises an elongate container which has an end opening and is partitioned internally into two contiguous housings. First longitudinal portions of the housings are each adapted to hold two stacks of cartridges in a staggered arrangement. A subsequent longitudinal portion of each housing has a width which decreases gradually towards the opening of the container and ends with a width substantially equal to the diameter of a cartridge. At their ends facing the opening, the housings open into an end portion of the container which also has a width that decreases gradually towards the opening. An elevator member is movable in the container under the action of resilient means to push the cartridges towards the opening. The bearing and thrust surfaces of the elevator member and the internal walls of the container are shaped so as to allow the removal of successive cartridges housed in the container without jamming, when in use in a firearm.

1 Claim, 5 Drawing Figures

MULTI-STACK CARTRIDGE MAGAZINE FOR FIREARMS

DESCRIPTION

The present invention relates to a multi-stack cartridge magazine for firearms, and in particular to a magazine of the type comprising an elongate container having an end opening for allowing the passage of one cartridge at a time and in which an elevator member is movable under the action of resilient means, the container being intended to hold a plurality of cartridges in a staggered side-by-side arrangement with their respective longitudinal axes substantially perpendicular to the direction of movement of the elevator member.

The object of the present invention is to provide a cartridge magazine for firearms of the aforesaid type, which has a relatively short length but is able to hold a large number of cartridges, in particular four staggered stacks of cartridges, and which is highly reliable in operation.

This object is achieved according to the invention by a magazine of the type specified above, the main characteristic of which lies in the fact that:

the container has at least one longitudinal median partition which extends throughout the greater part of the length of the container and divides the interior of the container into first and second cartridge housings, each of which has a first longitudinal portion remote from the opening of the container for holding respectively two stacks of cartridges staggered by half the diameter of a cartridge, and a second longitudinal portion close to the opening with a width which decreases gradually towards the opening to terminate with a width substantially equal to a cartridge diameter, the connecting zone between the first and second portions of the first housing being staggered by half a cartridge diameter in the direction of the opening of the container relative to the connecting zone between the corresponding portions of the second housing, the second portions of the housings opening into an end portion of the container adjacent the opening, the end portion of the container having a width which decreases gradually towards the opening; and in that:

the elevator member has first and second rest and thrust surfaces on which the respective stacks of cartridges in the first and second housings rest, the first surface being staggered by half a cartridge diameter in the longitudinal direction of the container towards the outlet opening relative to the second surface.

Further characteristics and advantages of the magazine according to the invention will become apparent from the detailed description which follows with reference to the appended drawings, provided purely by way of non limiting example, in which.

Figure 1:
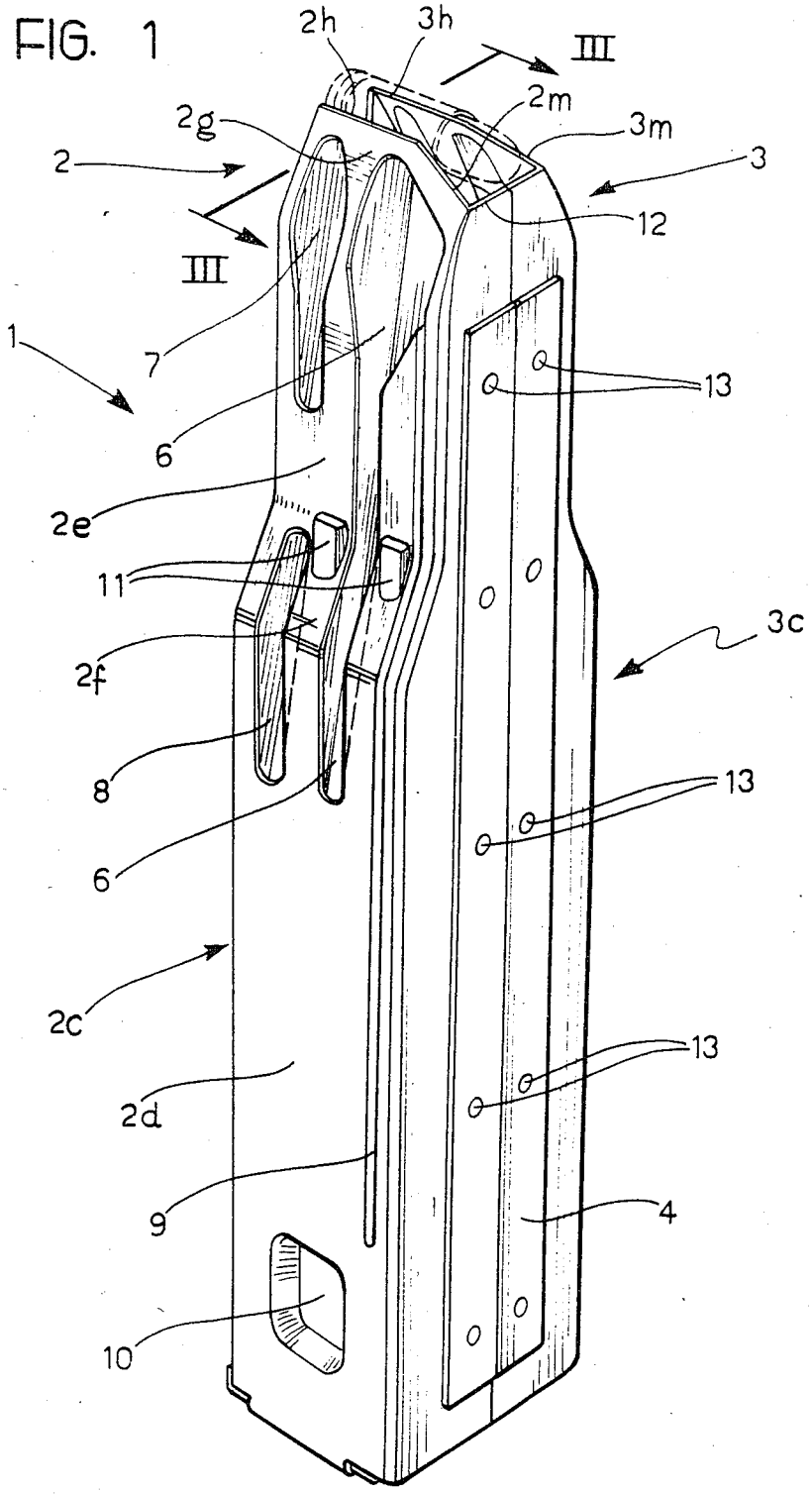
FIG. 1 is a perspective view of a magazine according to the invention.
Figure 2:
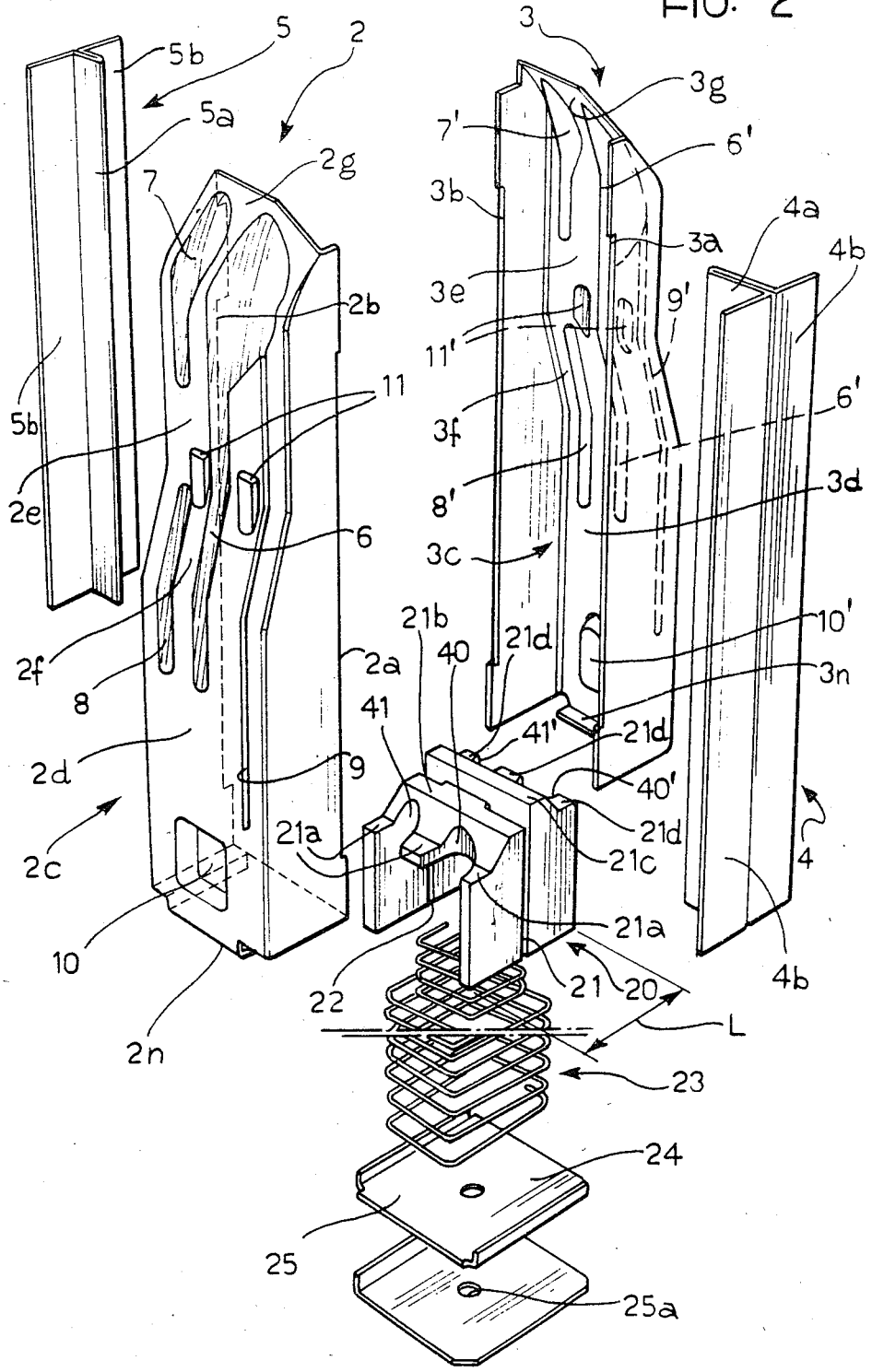
FIG. 2 is an exploded perspective view of the magazine of FIG. 1.

With reference to FIGS. 1 and 2, a cartridge magazine for firearms according to the invention is generally indicated 1. The magazine, in the embodiment shown, comprises a container constituted by two half-she11s 2, 3 of pressed sheet metal, each of which is substantially channel-shaped. The two half-shells are joined along respective sides or longitudinal edges 2*a*, 2*b* and 3*a*, 3*b*, which have slight rebates over the greater part of their lengths.

A first T-section 4, also of sheet metal, has its leg or web 4*a* inserted in the slot defined between the rebates of the edges 2*a* and 3*a* of the half-shells 2, 3. The flanges 4*b* of this section lie in contact with the outer surface of the half-shells 2, 3 adjacent the slot. A second T-section, indicated 5, has its web or leg 5*a* inserted in the slot defined by the rebates of the sides or edges 2*b*, 3*b* of the two half-shells; the flanges 5*b* of this section are in contact with the outer surface of the two half-shells adjacent the slot.

The sections 4 and 5 are fixed to the two half-shells by spot welds indicated 13 in FIG. 1.

Figure 4:
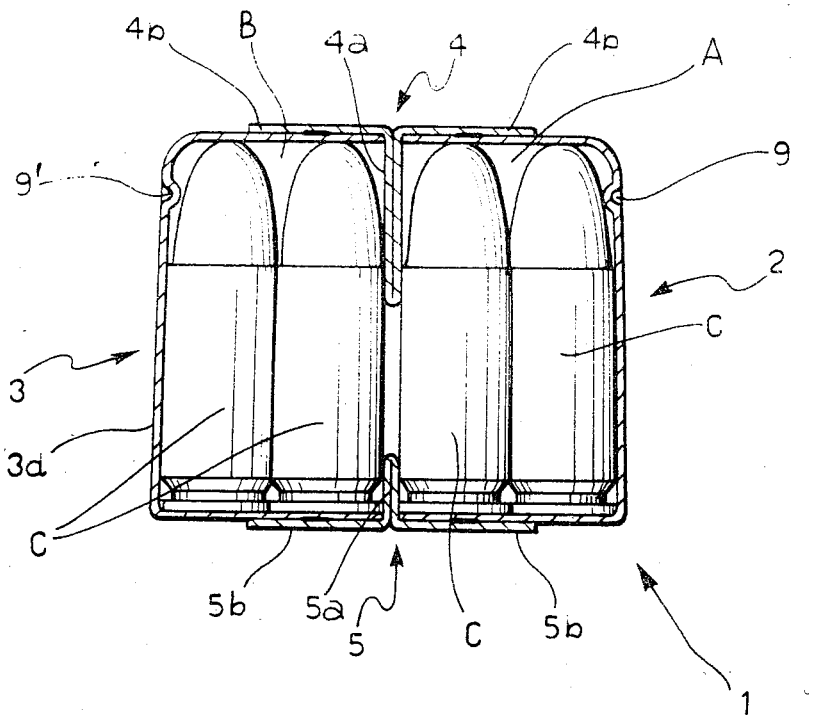
FIG. 4 is a cross-section taken on the line IV—IV of FIG. 3.
Figure 5:
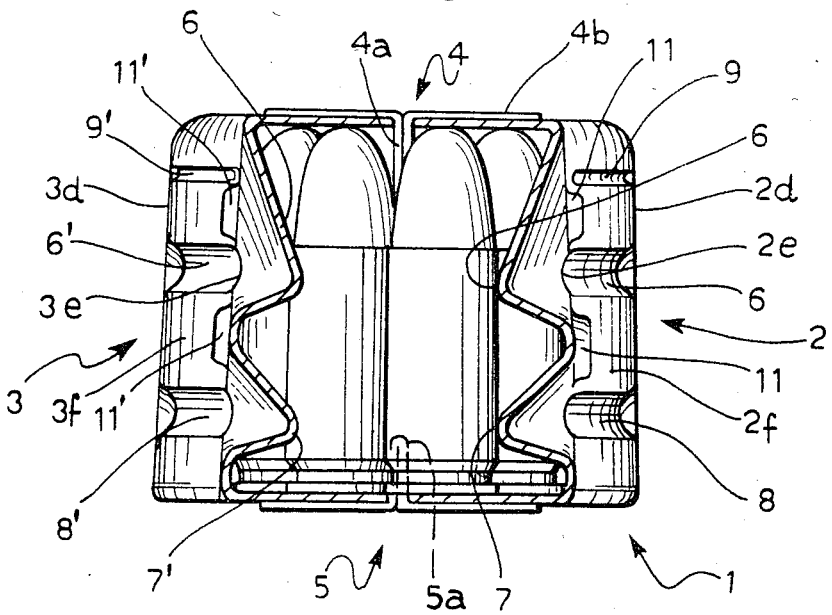
FIG 5 is a cross-section taken on the line V—V of FIG. 3.

As will be seen particularly in FIGS. 4 and 5, the legs or webs 4*a*, 5*a* of the two sections face each other and lie in the same plane, that is, in the longitudinal median plane of the container 1.

Figure 3:
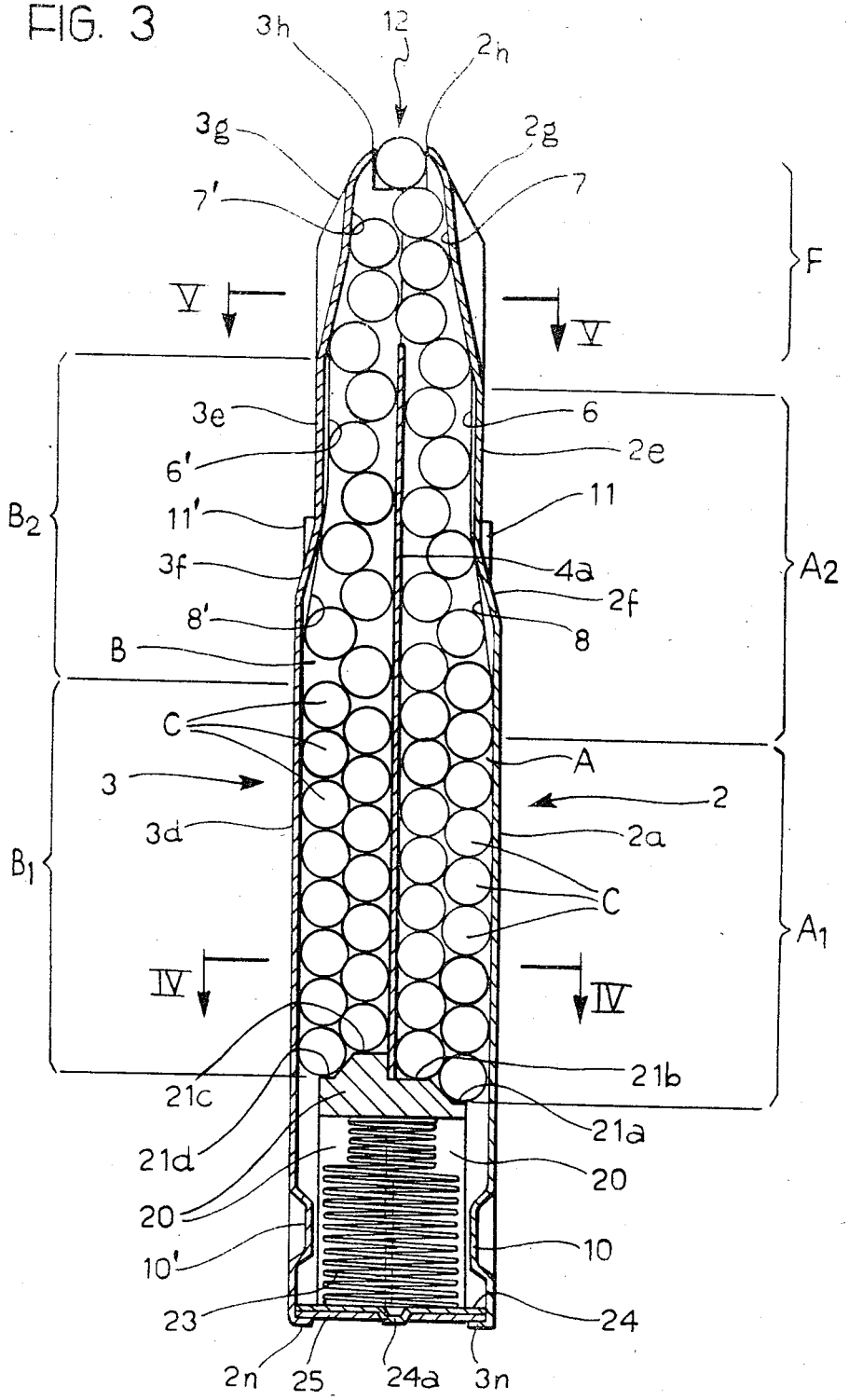
FIG. 3 is a longitudinal section taken on the line III—III of FIG. 1.

The half-shell 2, as is seen in FIGS. 1 to 3, has a shaped wall 2*c* comprising two wall portions 2*d*, 2*e* lying in parallel planes and connected together by an inclined wall portion 2*f*, and an end wall portion 2*g* inclined to the wall portion 2*e* as shown in the drawings.

Similarly, the shaped wall 3*c* of the half-shell 3 has two wall portions 3*d*, 3*e* lying in substantially parallel planes and connected by an intermediate wall portion 3*f*, and finally an end wall portion 3*g* inclined relative to the portion 3*e* as shown in the drawings As shown in FIGS. 1 and 2, a first inwardly-projecting rib 6 is formed on the wall 2*c* of the half-shell 2 and extends on the wall portions 2*g*, 2*e*, 2*f* and partly on the wall portion 2*d*. The rib 6 appears rather like a groove when seen from the outside and has a greater width and depth in its upper part, that is, in correspondence with the wall portion 2*g* and part of the wall portion 2*e*.

The shaped wall 2*c* also has a second rib-groove 7, also facing inwardly of the container, which extends longitudinally on the wall portion 2*g* and on a good part of the wall portion 2*e* beside the rib 6. A further rib-groove of the shaped wall 2*c*, indicated 8, extends longitudinally on the wall portion 2*f* and on part of the wall portion 2*d* beside a corresponding portion of the groove 6, as shown in FIGS. 1 and 2.

The shaped wall 2*c* has a further stiffening rib 9 which extends longitudinally over the wall portions 2*e*, 2*f* and 2*d*. The upper end of the rib 9 opens into the upper portion of the groove 6, having a greater width.

A substantially square-shaped depression formed in the lower wall of the portion 2*d* of the shaped wall 2*c* is indicated 10.

The outer face of the shaped wall 2*c* of the half-shell 2 also has two positioning projections 11 formed in the connecting zone between the portions 2*e* and 2*f* of this wall.

In FIG. 2, ribs, depressions and projections of the shaped wall 3*c*, of the half-shell 3 corresponding to the ribs, depressions and projections 6 to 11 of the shaped wall 2*c* of the half-shell 2 are indicated 6' to 11'.

The container 1, formed by the two half-shells 2, 3 and the sections 4, 5, has an upper elongate opening 12 with a longitudinal axis which lies substantially in the plane of the flanges or webs 4*a*, 5*a* of the sections 4 and 5. The upper end edges of the profiled walls 2*c*, 3*c* of the two half-shells have respective first sides 2h, 3h substantially parallel and almost perpendicular to the longitudinal axis of the container, and respective second sides 2m, 3m inclined and diverging so that the opening 12 has substantially a dovetail profile towards the front part of the magazine 1, which is cut in a plane inclined to the axis of the container 1.

As is seen from FIGS. 1 and 3, the distance between the side 2h and the side 3h is slightly less than the diameter of the base of a cartridge.

It is apparent from FIG. 1, however, that the distance between the sides 2m and 3m of the opening 12 increases gradually until it is considerably more than the diameter of the base of a cartridge.

In FIGS. 2 and 3, an elevator member of generally prismatic form is indicated 20 and, in a pair of opposing lateral faces, has two slits 21, 22 with depths corresponding to the extent of the web 4a of the section 4 and the web 5b of the section 5 respectively.

The elevator member 20 is mounted for movement in the container 1 along the webs or flanges of the said sections 4, 5, which act as guides, under the action of a helical spring 23 with rectangular coils.

As appears in particular from FIGS. 2 and 3, the spring 23 is disposed between the elevator member 20 and a plate 24 which rests on a base closure 25 which closes the lower end of the container 1. In particular, the plate 24 has a central downwardly projecting boss 24a and the base 25 has a central hole 25a for receiving the boss.

The half-shells 2, 3 have respective lower edges 2n, 3n which are bent towards each other and act as guides for the introduction, removal and support of the base 25.

Upon assembly, the elevator 20 is introduced into the container 1 through its lower opening, the spring 23 and then the plate 24 are inserted, and finally the base 25 is inserted until the boss 24a of the plate 24 snap-engages the hole 25a.

As seen in FIG. 3, the ribs 8 and 8' are not formed exactly opposite each other but the rib 8' is slightly offset upwardly relative to the rib 8. Similarly, the lower part of the rib 7', as shown in FIG. 3, begins at a slightly higher point than the beginning of the rib 7 facing it.

The lower part of the rib 6' also begins at a slightly higher point than the beginning of the rib 6.

In particular, the beginning and end of the rib 8' are offset upwardly relative to the beginning and end of the rib 8 by half the diameter of the base of a cartridge. Similarly, the beginning and end of the ribs 6' and 7' are offset upwardly by half the diameter of the base of a cartridge relative to the beginning and end of the ribs 6 and 7 respectively.

The ribs 6 to 8 and 6' to 8', as will be seen below, act to guide the ordered ascent of the cartridges towards the outlet opening 12 under the upward thrust exerted by the elevator member 20.

The projections 11, 11' and the depressions 10, 10', however, are formed in exactly opposite positions.

The flanges 4a and 5a of the T-sections 4 and 5 divide the interior of the container 1 into two housings, indicated A and B in FIGS. 3 and 4, which communicate with each other and are intended to hold cartridges indicated C. The housings A, B have respective first longitudinal portions $A_1$, $B_1$ between the upper face of the elevator member 20 and the beginnings of the rib 8 and the rib 8', respectively.

The housings A and B also have second longitudinal portions $A_2$, $B_2$ between the beginnings of the ribs 8 and 8' respectively and the beginnings of the ribs 7 and 7' respectively. The longitudinal portions $A_2$, $B_2$ of these housings have a width which decreases gradually towards the opening 12 of the container.

The longitudinal portions $A_1$, $A_2$ of the housing A are connected together at a distance which is offset downwardly by half the diameter of a cartridge relative to the connecting zone between the portions $B_1$, $B_2$ of the housing B.

The elevator member 20 has a shaped upper surface on which the cartridges C rest and which pushes the cartridges. More particularly, this surface is stepped and has four staggered rest planes indicated 21a to 21d (FIG. 3). The plane 21a is offset downwardly by half a cartridge diameter relative to the plane 21b, the plane 21c is staggered by half a cartridge diameter relative to the plane 21b, and, finally, the plane 21d is at the same level as the plane 21b.

As is apparent from FIG. 3, the portions $A_1$ and $B_1$ of the housings A and B may house respectively two stacks of cartridges C staggered by half the diameter of a cartridge.

Further cartridges C are housed in the portions $A_2$ and $B_2$ of these housings, these cartridges being increasingly staggered because of the reduction of the cross-section of these housings.

In operation, when the elevator member 20 advances upwardly, the relative staggering between the stacks of cartridges in the portions $A_1$ and $B_1$ remains constant, while the relative staggering of the cartridges which pass through the portions $A_2$ and $B_2$ of the housings A and B increases progressively.

The portions $A_2$ and $B_2$ of the housings open into the end portion F of the container 1 adjacent the outlet opening 12.

In operation, a cartridge coming from the housing A and a cartridge coming from the housing B rise alternatively into the end portion F of the container as a result of a thrust from the elevator member 20 and the shape of the walls of the housings A and B. The guide ribs 7, 7' define a progressive restriction of the passage section of the end portion F of the container towards the outlet opening 12. The cartridges C rising through this end portion of the container are thus staggered and unable to jam.

The elevator member 20 has a width L (FIG. 2) substantially equal to the distance between the inner faces of the wall portions 2e, 3e of the two half-shells. Moreover, on its sides facing the shaped walls 2c, 3c of the two half-shells, this elevator member has depressions, indicated 40, 41 and 40', 41' in FIG. 2, with shapes substantially complementary to the shapes of the upper portions of the ribs 6, 7 and 6', 7' respectively. Hence, the rest and thrust surface of the elevator member 20 may reach a position close to the outlet opening 12.

In use, the cartridges C are introduced into the magazine described above by pushing the elevator member 20 downwardly against the action of the spring 23. The illustrated magazine is able to hold 52 cartridges.

Each individual cartridge is introducted into the magazine through the opening 12, its base first being made to pass into the dovetail-shaped part of this opening and the cartridge then being moved axially towards the rear part of the magazine so that its base is beneath the sides 2h, 3h of this opening. A pressure is then exerted on the cartridge which enters the container and forces the elevator member downwards.

The magazine described and illustrated above is intended for use in automatic or semi-automatic firearms having a tubular guide element for the insertion of the magazine. The projections 11, 11' of the two half-shells are intended to act as stop members during the insertion of the magazine into the tubular guide element.

The cartridges, in use, are removed from the magazine by a shaped heel of a type known per se, with which the breech-block of the gun is provided.

The magazine according to the invention has the advantage of having a high ammunition capacity while being of relatively short length.

The basic characteristics of the magazine, which allows linear operation without jamming, lies essentially in the fact that the four stacks of cartridges housed in the lower portions of the two housings A, B described above are thrust by a single elevator member having, in the two housings, rest and thrust surfaces which are staggered by half the diameter of a cartridge. Moreover, the subsequent changes (restrictions) in the passage section for the cartridges towards the outlet opening are formed in the two housings so as to be staggered by half the diameter of a cartridge.

In the embodiment illustrated, the magazine may be formed entirely of cut, folded and pressed sheet metal.

It is thus simple and economical to manufacture and very quick to assemble.

Naturally, the principle of the invention remaining the same, the embodiments and details of construction may be varied widely with respect to that described and illustrated purely by way of non-limiting example, without thereby departing from the scope of the present invention.

I claim:

1. A cartridge magazine for firearms, of the type comprising an elongate container with an end opening for the passage of a cartridge and an elevator member movable in the container under the action of resilient means, said container being intended to hold a plurality of cartridges in a staggered side-by-side arrangement with their longitudinal axes substantially perpendicular to the direction of movement of the elevator member, wherein the improvements consist in:

said container having at least one longitudinal median partition which extends throughout the greater part of the length of the container and divides it internally into first and second housings for said cartridges, each said housing having a first longitudinal portion remote from said opening of the container for holding respectively two stacks of cartridges staggered by half a cartridge diameter, and a second longitudinal portion close to said opening and having a width which decreases gradually towards said opening to terminate with a width slightly greater than a cartridge diameter, said first and second portions of said first housing being connected at a zone which is staggered by half a cartridge diameter in the direction of the opening relative to the connecting zone between the corresponding portions of the said second housing;

said container having an end portion adjacent said opening, into which said second housing portions open, said end portion having a width which decreases gradually towards the opening, and said elevator member being comprised of a single rigid body having first and second surfaces located in each housing on which the respective stacks of cartridges in said first and second housings rest, said first surface in each housing being staggered by half a cartridge diameter in the longitudinal direction of the container towards said opening relative to said second surface in each housing, said housings each having internal guide ribs in said second portions and said end portion and said elevator member having complementary recesses on opposite sides thereof for receiving said ribs as said elevator rides so that said elevator may rise the full length of said magazine without undue frictional contact with the walls of said housings.

* * * * *